US006679753B1

(12) United States Patent
Motosko

(10) Patent No.: US 6,679,753 B1
(45) Date of Patent: Jan. 20, 2004

(54) WIRELESS CONTROL LOW PROFILE MINIATURE TOY CAR

(76) Inventor: Stephen J. Motosko, 132 Sand Dollar La., Sarasota, FL (US) 34242

( * ) Notice: Subject to any disclaimer, the term of this patent is extended or adjusted under 35 U.S.C. 154(b) by 0 days.

(21) Appl. No.: 10/327,416

(22) Filed: Dec. 20, 2002

(51) Int. Cl.[7] ..... A63H 30/00

(52) U.S. Cl. ..... 446/454; 446/456; 446/470; 446/431

(58) Field of Search ..... 446/454, 456, 446/457, 460, 462, 463, 465, 470, 439, 438, 431

(56) References Cited

U.S. PATENT DOCUMENTS

| | | | | | |
|---|---|---|---|---|---|
| 3,629,680 | A | | 12/1971 | Baynes | |
| 3,717,952 | A | * | 2/1973 | Strongin | 446/436 |
| 4,086,724 | A | * | 5/1978 | McCaslin | 446/175 |
| 4,112,615 | A | | 9/1978 | Ishimoto | |
| 4,160,253 | A | | 7/1979 | Mabuchi | |
| 4,254,577 | A | * | 3/1981 | Cheng | 446/444 |
| 4,547,166 | A | * | 10/1985 | Goldfarb et al. | 446/164 |
| 4,563,626 | A | | 1/1986 | Ohtake | |
| 4,636,178 | A | * | 1/1987 | Oda | 446/462 |
| 4,739,232 | A | | 4/1988 | Ishimoto | |
| 4,764,150 | A | * | 8/1988 | Uchino | 446/456 |
| 4,940,442 | A | * | 7/1990 | Matsuda | 446/465 |
| 5,061,579 | A | | 10/1991 | Ishimoto | |
| 5,135,427 | A | * | 8/1992 | Suto et al. | 446/433 |
| 5,261,853 | A | * | 11/1993 | Suto | 446/433 |
| 5,334,076 | A | | 8/1994 | Shinozuka | |
| 5,722,873 | A | | 3/1998 | Ishimoto | |
| 5,830,038 | A | * | 11/1998 | Fekete et al. | 446/436 |
| 5,882,241 | A | * | 3/1999 | Mullaney et al. | 446/462 |
| 5,919,075 | A | * | 7/1999 | George et al. | 446/437 |
| 6,024,627 | A | * | 2/2000 | Tilbor et al. | 446/456 |
| 6,095,890 | A | * | 8/2000 | George et al. | 446/437 |
| 6,171,171 | B1 | * | 1/2001 | Barthold | 446/438 |
| 2003/0077979 | A1 | * | 4/2003 | Hoeting et al. | 446/431 |

FOREIGN PATENT DOCUMENTS

| | | | | |
|---|---|---|---|---|
| JP | 06134146 | A | * 5/1994 | A63H/17/26 |

* cited by examiner

*Primary Examiner*—Derris H. Banks
*Assistant Examiner*—Urszula M Cegielnik

(57) ABSTRACT

A wireless control miniature low-profile toy car comprising a chassis for supporting front and rear wheels, a front wheel steering mechanism, a covered control circuit board therefor, a drive motor and a battery. A shell miniature car body is attached to and substantially covers the chassis. The circuit board is positioned and secured atop a bottom panel of the chassis, while the battery is positioned and secured above the circuit board and at least partially within a central raised portion of the car body whereby the height of the central raised portion of the car body is substantially reduced. The front steering includes an upright pivot shaft connected at an upper end thereof to a mating cavity or aperture formed on a front hood of said car body which allows a further reduction in profile height of the hood of the toy car.

8 Claims, 1 Drawing Sheet

WIRELESS CONTROL LOW PROFILE MINIATURE TOY CAR

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to miniature remote controlled toy cars and more particularly to a miniature wireless control car with a substantially reduced, sleek profile of the car body.

2. Description of Related Art

Miniaturized toy cars which are controlled wirelessly through a battery-powered transmitter, the control signals being received by a battery-powered onboard receiver within the miniature toy, car are well known and have become quite popular as the ability to miniaturize the necessary components for remotely controlling the toy car have been themselves miniaturized. These wireless controlled miniature toy cars typically include a chassis to which the various car and system components are supportively attached, including the control circuit board, battery for powering both the circuit and the signal receiver contained therein, as well as the drive motor. The battery has been made rechargeable so that it is also permanently mounted within the chassis. The entire arrangement is decoratively concealed by a shell car body which may be designed with a virtually infinite level of artistic detail.

However, due to the size of the rechargeable battery and the accompanying protectively covered circuit board, the typical arrangement of these components within the car body and atop or within the chassis is awkward. The battery is typically placed at a lowest point within the central portion of the chassis, while the fairly large length and width of the protectively covered circuit board is typically mounted above the chassis and battery and generally within the raised central portion of the car body which defines the passenger area of the miniature car. Certain handling and performance benefits have been achieved by placement of the heavier rechargeable battery at a lowest point within the chassis. However, due to the size of the protectively covered control circuit board and its positioning above the rechargeable battery and the chassis, the height and overall side profile of the miniature car is dictated to be somewhat enlarged and heightened and disproportionately configured to the typical shape of a miniature car, whether it be a sleek design or one of a NASCAR racer.

Moreover, the components of the miniaturized front wheel steering mechanism typically include an elongated upright coaxial upper and lower pivot shafts connected to each front wheel support which is controlledly pivotable to steer the vehicle by a suitable steering linkage attached between a miniaturized servo mechanism and each wheel support within the vehicle. Because the upper pivot shaft is connected for axial rotation only to an upper panel of the chassis, the car body load must be positioned thereabove which further heightens and exaggerates the unrealism of the profile of miniature toy cars.

The present invention introduces two refinements to the above structure with respect to the arrangement of the protectively covered circuit board and the rechargeable battery and further with respect to the elimination of the upper chassis panel which supports the upper end of the upper pivot shaft. That upper chassis panel is replaced by suitably prepared pockets or apertures formed into the front hood of the car body. Individually or combined, both of these improvements provide for substantial opportunities to reduce the overall profile height and exaggerated configuration of the toy body itself to allow it to be made more realistic.

BRIEF SUMMARY OF THE INVENTION

This invention is directed to a wireless control miniature low-profile toy car comprising a chassis for supporting front and rear wheels, a front wheel steering mechanism, a control circuit board therefor with cover optional, a drive motor and a battery. A shell miniature car body is attached to and substantially covers the chassis. The circuit board is positioned and secured atop a bottom panel of the chassis, while the battery is positioned and secured above the circuit board and at least partially within a central raised portion of the car body whereby the height of the central raised portion of the car body is substantially reduced. The front steering includes an upright pivot shaft arrangement connected at an upper end thereof to a mating cavity or aperture formed on a front hood of the car body which allows a further reduction in profile height of the hood of the toy car.

It is therefore an object of this invention to provide a wireless controlled miniature toy car with a more realistic side profile more similar to that of a full sized car.

It is yet another object of this invention to provide a unique arrangement of components within the car body of a miniature wireless toy car which enhance the opportunity for lowering the overall profile of the toy car.

Still another object of this invention is to simplify the chassis of a wireless control miniature toy car by eliminating the upper steering system support and replacing it with suitable cavities or apertures formed directly into or on the inner surface of the hood of the car body itself.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Prior Art

Figure 1:
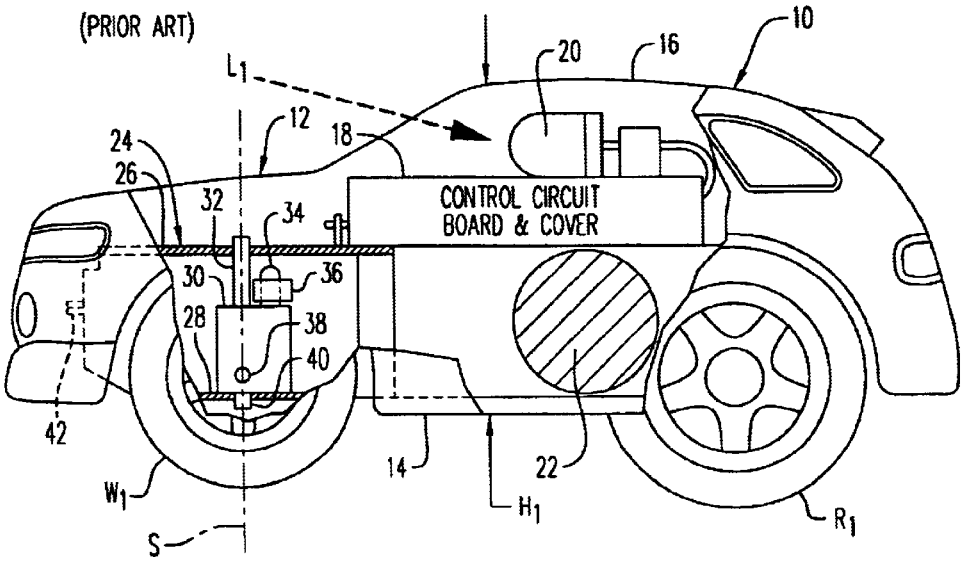
FIG. 1 (PRIOR ART)
FIG. 1 is a broken side elevation view of a typical prior art wireless controlled miniature toy car.

Referring now to the drawings, and firstly to FIG. 1, a typical prior art wireless controlled (or radio-controlled)

miniature toy car is there shown generally at numeral 10. Such miniature toy cars are typically easily hand-holdable and not much bigger than the size of a small matchbox. This miniature toy car 10 is in the range of 2½" long, 1¼" wide, and 1⅛" high and includes a chassis 24 and a molded thin wall (shell) plastic car body 12 which is attached at a front end thereof at 42 to the chassis 24 at the rear areas thereof by a threaded fastener (not shown).

A rechargeable battery 22 is secured against and atop the bottom panel 14 of the chassis 24 and transversely oriented to the length of the toy car 10 as shown. Other components typically within such a miniature toy car 10, including the drive motor and gear train and steering servo control are not shown for clarity.

A control circuit board with protective cover 18 having a width just slightly smaller than that of the miniature car 10 itself, is typically positioned along and attached to the upper margin of the chassis 24. The circuit board 18 includes a small l.e.d. 20 for indicating when the control circuit board 18 has been actuated. Positioning of this control circuit board and cover 18 is generally dictated to be within the enlarged passenger area 16 of the car body 12 to provide clearance for the l.e.d. 20 and also to provide a line of side of the l.e.d. 20 in the direction of arrow L1 through the transparent or open windshield area of the car body 12. By the above described arrangement of prior art components, a minimum height H1 between bottom panel 14 and the top 16 of the car body 12 is established, that height H1 being exaggerated and larger than the realistic proportions of a full sized car.

Still referring to FIG. 1, a typical steering mechanism (not including a control servo for clarity) is there shown and includes a steering hub 30 adjacent and just inboard of each front wheel W1 having an aperture 38 which supportively receives a small axel (not shown) in the configuration of an elongated frictionally engagable shank and enlarged decorative head to support the front wheel W1.

Elongated upright upper and lower pivotal steering shafts 32 and 40 are connected to the hub 30 extending coaxially upward and downwardly as shown. The upper steering shaft 32 is supportively engaged for rotation only through an upper panel 26 of the chassis 24. The lower steering shaft 40 is supported for rotation only within a lower panel 28 of chassis 24.

A steering pin 34 connected to and upwardly extending from hub 30 is pivotally connected to a transverse steering linkage 36 which, in turn, is connected to an output of the steering servo (not shown). By this arrangement, the hub 30 is controlledly rotated about an upright steering axis S of each front wheel W1 to effect remote controlled steering of the toy car 10 while underway. Propulsion of the toy car 10 is effected by a driving motor (not shown) in operative communication with a geared engagement with the rear wheels R1.

The Invention

Figure 2:
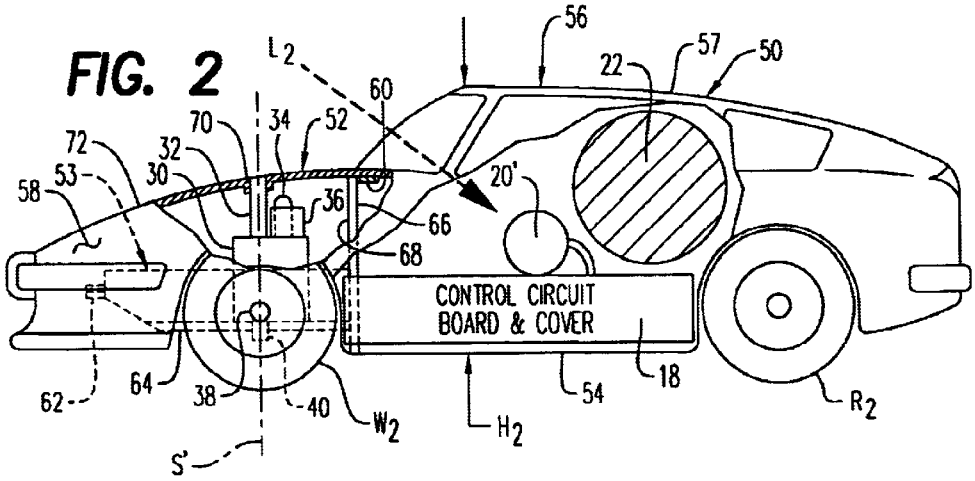
FIG. 2 is a broken side elevation view of a low profile reduced in height wireless controlled miniature toy car embodying aspects of the present invention.

Referring now to FIG. 2, a preferred embodiment of the invention is there shown generally at numeral 50 and includes a two part shell car body formed of a main body portion 56 and a front body or hood portion 52, each of which is attached atop a reduced-in-size chassis 53. The control circuit board and cover 18 as previously described has been repositioned and secured atop the bottom panel 54 of the chassis 53 and positioned longitudinally between the front and rear wheels W2 and R2, respectively, as shown. Because the circuit board and L.E.D. are substantially lowered and protectively positioned within the chassis 53, the protective cover is not necessary and is preferably deleted.

The rechargeable battery 22 has been elevated and positioned so as to occupy the vertical space between the top of the covered control circuit bard 18 and the lowered roof profile 57 of the passenger compartment of the toy car 50.

Again, the drive motor and associated gear train which operably propels the rear wheel R2 is not shown for clarity. The l.e.d. 20' has been reoriented transversely to the length of the toy car 50 and is viewable by line of site L2 through the open or transparent windshield. By this arrangement, the overall height H2 of the toy car 50 has been substantially reduced in the range of approximately 20%.

The front or hood portion 52 is attached by a tab 60 which lockably engages below the windshield and a threaded fastener attached at 62 to the chassis 53. The rear upright margin 66 of the hood portion 52 mates with the front upright margin 68 of the main portion 56 of the car body.

The steering mechanism of this preferred embodiment 50 is generally the same as previously described with respect to the prior art toy car 10 of FIG. 1. These steering components include a hub 30 positioned inboard and adjacent each of the front wheels W2 which supports an axle 38 to allow each of the front wheels W2 to freely rotate. The hub 30 is held for pivotal movement only about an upright steering axis S' by the upper pivot or steering shaft 32 which are supported within a pocket 70 formed into the molded hood 72 of the front car body or hood portion 52 while the lower pivot shaft 40 is pivotally engaged through an aperture formed into a lower panel 64 of the chassis 53. The steering pin 34 is operably engaged with a steering linkage 36 which, in turn, is operably connected to the output of a steering servo (not shown) as previously described to effect wireless controlled steering of the toy car 50.

As should be now more clearly understood, and in viewing the overall profiles of the prior art toy car 10 in FIG. 1 versus the present invention 50 shown in FIG. 2, the height and sleekness of the profile of the present invention has been substantially enhanced and lowered so that this miniature toy car 50 has the appearance, proportions and realism in appearance of a normal full-sized vehicle.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A wireless control miniature low-profile toy car comprising:

a chassis supporting front and rear wheels, a front wheel steering mechanism, a control circuit board therefor, a drive motor and a battery;

a shell miniature car body attached to and substantially covering said chassis;

said circuit board positioned and secured atop or in close proximity above a bottom panel of said chassis, said battery positioned and secured above said circuit board and at least partially within a central raised portion of said car body whereby the height of said central raised portion is lessened.

2. A wireless control miniature toy car as set forth in claim 1, wherein:

said front steering includes an upright pivot member about which said front wheels are controlledly steered, said pivot member being connected for substantially only pivotal movement at a lower end thereof to said bottom panel of said chassis and at an upper end of said pivot member, only to a mating cavity or aperture formed on a front hood of said car body.

3. A wireless control miniature low-profile toy car comprising:

a chassis supporting front and rear wheels, a front wheel steering mechanism, a control circuit board therefor, a drive motor and a battery;

a shell miniature car body having a front hood and being attached to and substantially covering said chassis;

said front steering including an upright pivot member about which said front wheels are controlledly steered, said pivot member being connected for substantially only pivotal movement at a lower end thereof to a lower panel of said chassis and at an upper end of said pivot member only to a mating cavity or aperture formed on the said front hood of said car body.

4. In a wireless control miniature low-profile toy car comprising a chassis supporting front and rear wheels, a front wheel steering mechanism, a control circuit board therefor, a drive motor and a battery, a shell miniature car body attached to and substantially covering said chassis, the improvements comprising:

said circuit board is positioned and secured atop or in close proximity above a bottom panel of said chassis, said battery being positioned and secured above said circuit board and at least partially within a central raised portion of said car body whereby the height of said central raised portion is lessened.

5. The improvement of claim 4, wherein:

said front steering includes an upright pivot member about which said front wheels are controlledly steered, said pivot member being connected for substantially only pivotal movement at a lower end thereof to said bottom panel of said chassis and at an upper end of said pivot member, only to a mating cavity or aperture formed on a front hood of said car body.

6. In a wireless control miniature low-profile toy car comprising a chassis supporting front and rear wheels, a front wheel steering mechanism, a control circuit board therefor, a drive motor and a battery, a shell miniature car body attached to and substantially covering said chassis, said front steering including an upright pivot member about which said front wheels are controlledly steered, the improvement comprising:

said pivot member being connected for substantially only pivotal movement at a lower end thereof to a lower panel of said chassis and at an upper end of said pivot member only to a mating cavity or aperture formed on a front hood of said car body and terminating downwardly in proximity to said front hood.

7. A component arrangement for wireless control miniature low-profile toy car comprising a chassis supporting front and rear wheels, a front wheel steering mechanism, a control circuit board therefor, a drive motor and a battery, a shell miniature car body attached to and substantially covering said chassis, said component arrangement comprising:

said circuit board is positioned and secured atop or in close proximity above a bottom panel of said chassis, said battery positioned and secured above said circuit board and at least partially within a central raised portion of said car body whereby the height of said central raised portion is lessened.

8. The component arrangement of claim 7, wherein:

said front steering includes an upright pivot member about which said front wheels are controlledly steered, said pivot member being connected for substantially only pivotal movement at a lower end thereof to said bottom panel of said chassis and at an upper end of said pivot member, only to a mating cavity or aperture formed on a front hood of said car body.

* * * * *